US006761117B1

(12) United States Patent
Benz

(10) Patent No.: US 6,761,117 B1
(45) Date of Patent: Jul. 13, 2004

(54) TACTICAL RECONNAISSANCE AND ORDNANCE SYSTEM

(75) Inventor: Mark Douglas Benz, Fremont, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/303,975

(22) Filed: Nov. 26, 2002

(51) Int. Cl.[7] ..... F42B 27/00
(52) U.S. Cl. ..... 102/482; 89/1.11; 434/11
(58) Field of Search ..... 89/1.11; 434/11; 102/201, 482

(56) References Cited

U.S. PATENT DOCUMENTS 5,246,372 A * 9/1993 Campagnuolo et al. ..... 434/11
H001451 H * 6/1995 Campagnuolo ..... 434/11
6,244,535 B1 * 6/2001 Felix ..... 244/3.16
6,460,460 B1 * 10/2002 Jasper et al. ..... 102/201
6,604,946 B2 * 8/2003 Oakes ..... 434/11

* cited by examiner

*Primary Examiner*—Michael J. Carone
*Assistant Examiner*—Troy Chambers
(74) *Attorney, Agent, or Firm*—Townsend and Townsend and Crew LLP

(57) ABSTRACT

With typical ordnance systems, for example, grenades, a user must decide to explode the ordnance before the actual device is thrown. However, in many situations, it can be useful to be able to throw an ordnance system and make a decision to explode the device after it has landed. The present invention comprises a combined reconnaissance and ordnance device. The present invention is capable of real time acquisition of data, for example, digital still images, or video and audio data. The present invention also comprises a two way communications ability. By acquiring and then transmitting data to a remote console, the present invention allows a user to observe a given situation. After observing the environment surrounding the ordnance system, a user can determine whether or not to explode the ordnance system.

9 Claims, 4 Drawing Sheets

FIG.5A
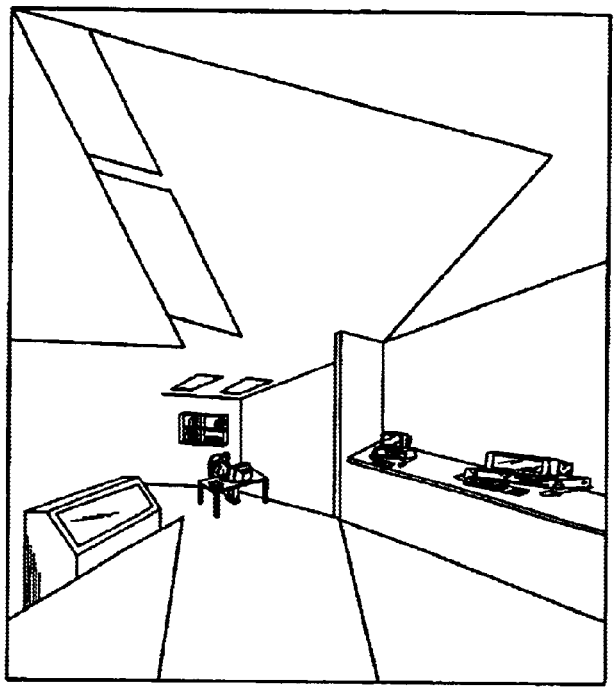
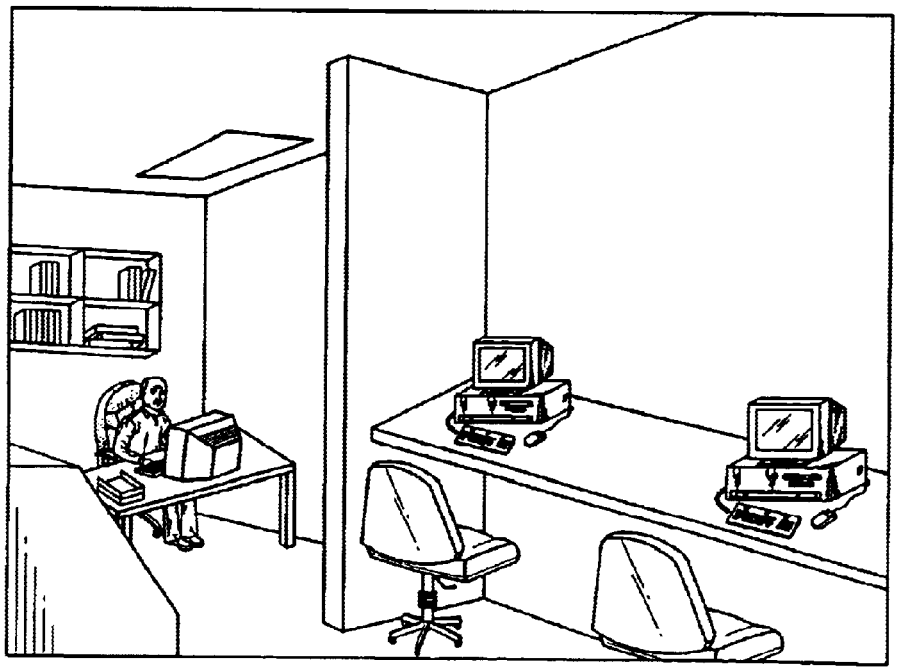
FIG.5B

TACTICAL RECONNAISSANCE AND ORDNANCE SYSTEM

BACKGROUND OF THE INVENTION

1. Field of the Invention

The present invention relates to a tactical reconnaissance and ordnance system. More specifically, the present invention comprises an apparatus for incorporating a data acquisition system with an ordnance system.

2. Background of the Invention

Real time data about enemy location, strength and intentions, whether strategic or tactical, are critical to military personnel in the field. In particular, the specific knowledge of, for example, the location, quantity, and/or activity of individual or grouped non-friendly personnel or vehicles can be very useful. Knowledge of these factors can sometimes mean the difference between a quick tactical victory and unnecessary casualties. As enemies become more sophisticated, this information typically becomes more difficult to obtain. In addition, this information can change rapidly, adding further difficulties to data acquisition and decision making. For example, reconnaissance or Special Operations forces face a variety of threats from both seen and unseen "non-friendlies." In these situations, the unseen threats can cause the most disruption an casualties to friendly forces. In order to reduce casualties, these threats must be minimized. To minimize seen, as well as unseen threats, a system for collecting, assessing, and acting on improved, real time tactical data on adversaries is required.

A continuing need exists for a tactical reconnaissance and ordnance system.

SUMMARY OF THE INVENTION

An object of the present invention is to provide a combined reconnaissance and ordnance system.

Another object of the present invention is to provide a reconnaissance system to provide personnel with early warning of enemy activity.

Yet another object of the present invention is to provide a method of monitoring buildings, caves, or bunkers.

Still another object of the present invention is provide the ability to view what is at, in, or around an intended target area.

Still another object of the present invention is to provide the ability to decide whether or not to detonate ordnance.

Still another object of the present invention is to provide an apparatus for two way communication with an ordnance system.

The present invention achieves the above and other objects by providing a reconnaissance and ordnance device, comprising: an imaging system; a processing system operatively connected to the imaging system; a communication system operatively connected to the processing system; a ordnance system operatively connected to the processing system; and a power system operatively connected to the imaging system, to the processing system, to the communication system, and to the ordnance system.

BRIEF DESCRIPTION OF THE DRAWINGS

FIGS. 5*a–b* show exemplary corrected and uncorrected camera images.

Other and further objects of the present invention will be apparent from the following description and claims and are illustrated in the accompanying drawing, which by way of illustration, show preferred embodiments of the present invention. Other embodiments of the invention embodying the same or equivalent principles may be used and structural changes may be made as desired by those skilled in art without departing from the present invention and the purview of the appended claims.

DETAILED DESCRIPTION OF THE PREFERRED EMBODIMENTS

The present invention relates to a "smart grenade" system. In the exemplary embodiment of the present invention, the smart grenade system is capable of obtaining real time image and audio data so that users can survey the grenade's surroundings. Upon observing the images, a user can detect and monitor non-friendly or other activity. In the exemplary embodiment, the present invention also provides for detonating the grenade's ordnance, if so equipped.

Figure 1:
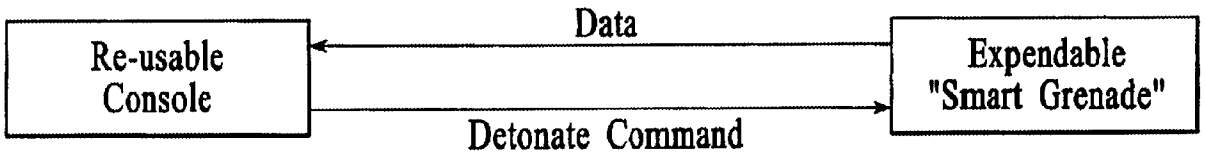
FIG. 1 is a block diagram showing an overview of two exemplary parts of a system embodying the present invention.

FIG. 1 is a block diagram showing an overview of two exemplary parts of a system embodying the present invention. In the exemplary embodiment, the present invention comprises two major components. These components are, for example, a re-usable display console and a plurality of remote imaging sensor units. In the exemplary embodiment, the re-usable display is typically, for example, a hand-held communications and utility console. However, many types of displays can be used. The present invention is not intended to be limited to hand held consoles or re-usable displays. For example, disposable display consoles, fixed permanent consoles, or other types of remote consoles can be used in accordance with the present invention. In the exemplary embodiment, the plurality of remote imaging sensors can comprise, for example, cameras, microphones, data links, and optional ordnance. The present invention is not intended to be limited to sensors. Other electrical or mechanical devices can be incorporated in accordance with the present invention, depending on the objectives of a particular application.

In the exemplary embodiment, the smart grenade is substantially similar to a traditional grenade in size and use. However, the smart grenade has sensors that collect and send images and other data from their immediate surroundings. These data are sent to the user for review. Based on, for example, the images and data that the sensors provide, a user may choose to detonate the grenade or pursue other courses of action to achieve the objectives of a particular mission. The present invention can be altered to, for example, improve range, improve image resolution, to make consoles more durable, or to add different types of sensors, for example, vibration or radiation sensors.

Figure 2:
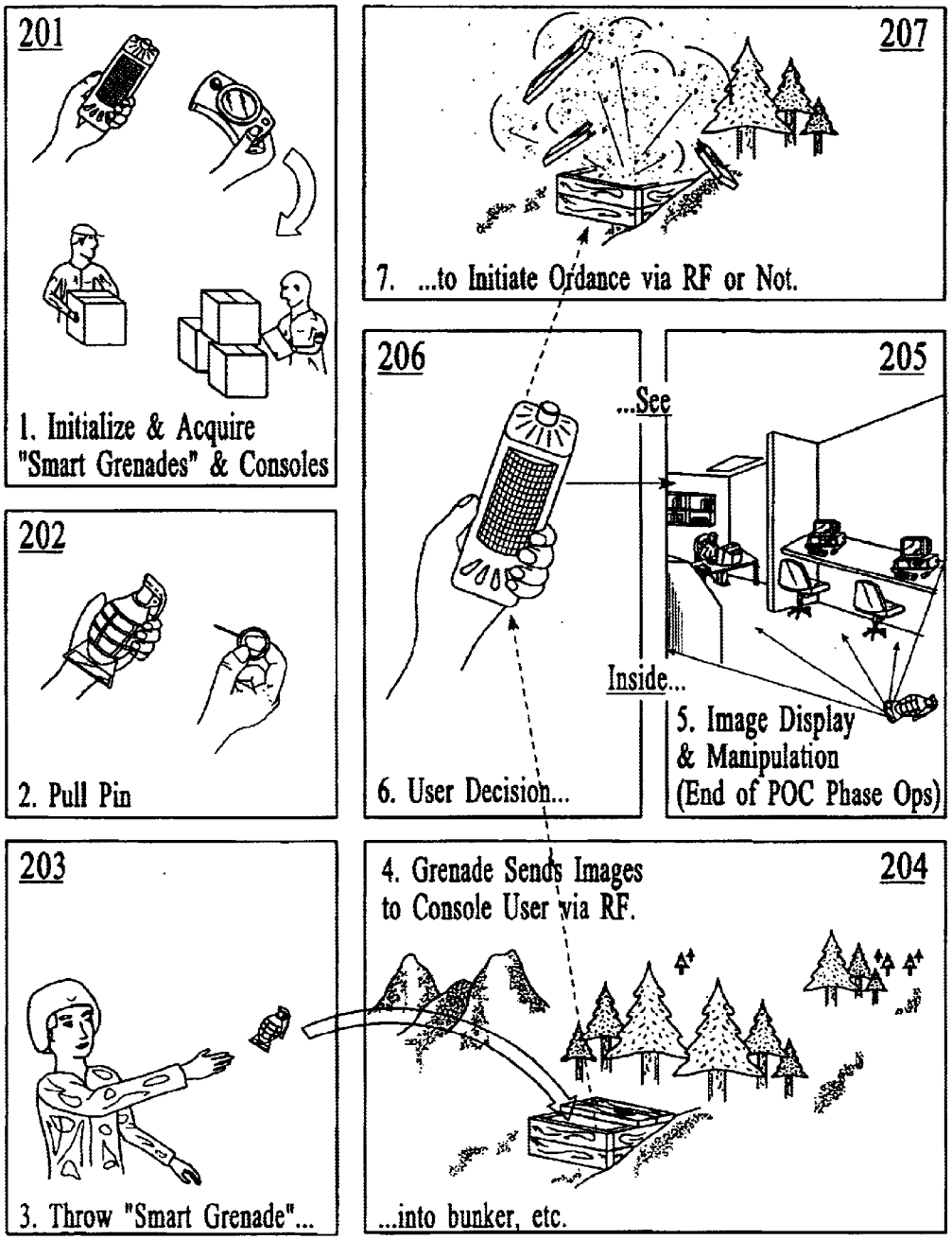
FIG. 2 is a diagram showing exemplary method steps in accordance with a preferred embodiment of the present invention.

FIG. 2 is a diagram showing exemplary method steps in accordance with a preferred embodiment of the present invention. In the preferred embodiment, system user personnel, described as the "thrower" and "console user," can be the same or different people. In the first step 201, trained personnel initialize the smart grenade's. In the preferred embodiment, this is done by first activating the console. After the console has been activated, a barcode on one or more grenades is "scanned" by the console, or suitable device whereby the barcode data is transferred to the console. Any type of scanning device can be used in accordance with the present invention. The scanning device can be separate from the console, or it may be incorporated into the console. Once the grenade has been initialized, it will enable the console to receive information from the grenade. The present invention is not limited to one grenade per console. Any number of grenades can be initialized using a given console. In another embodiment, one grenade can be initialized using several consoles, so that several users may receive data from a given grenade. After initialization, the grenade can be thrown by the console user, or another user, at any time.

Similar to a traditional grenade, the thrower must pull (forcibly remove) the smart grenade activation pin. This is illustrated in FIG. 2 by exemplary step 202. Once the activation pin has been removed, the circuit between, for example, the grenade's battery, electronics, and cameras, are activated. Additionally, in the preferred embodiment, the ordnance is also activated. In the preferred embodiment, once the pin has been pulled, the grenade is "live," which means it is, for example, collecting and transmitting image and audio data to the console. In the preferred embodiment, the data acquisition and transmission takes place until the power terminates. However, this is not intended to limit the present invention. For example, the grenade's ordnance can be designed to be remotely activated after the pin has been removed. In addition, the present invention can be designed to cease acquisition and transmission of data at a predetermined time, or when remotely instructed to do so, before the power supply is depleted.

In the third exemplary step 203, a thrower actually throws the live smart grenade at, in, or onto the target. In the preferred embodiment, the grenade transmits image and audio data while in flight and after landing at, in, or near the intended target. This is illustrated by exemplary step 204. In exemplary step 205, the console user may view the images from the smart grenade's cameras and listen to any audio data collected and transmitted. The user may switch between, for example, the display of all images of the scene around the grenade, or any one of the images in a larger format. In the preferred embodiment, the console can also be designed to perform functions similar to a VCR, for example, scrolling through the acquired images. In the preferred embodiment, the scrolling function can be helpful when, for example, a grenade lands under an object such as a table or a bush that restricts its field of view. In such a situation, the user can scroll back to images captured before the smart grenade went under the object. In this way, a user has the ability to see images that may show more of the target.

After viewing the images that have been acquired and transmitted by the grenade, the user determines whether or not to detonate the ordnance, shown in exemplary step 206. In the preferred embodiment of the present invention, if a decision to detonate the ordnance is made, the user depresses, for example, two designated "boom buttons" on the console. The use of two boom buttons in the preferred embodiment is intended to decrease the chance of accidental detonation, while avoiding significant delay. However, this is just one example of a detonation mechanism. Any type of method or apparatus may be used to detonate the ordnance, and can be designed according to the objectives of a particular application.

Once the two boom buttons are depressed, the console sends a command to the specific grenade, as shown by exemplary step 207. In the preferred embodiment, this command is sent via, for example, a RF signal. As will be recognized by those skilled in the art, the signal can be transmitted in any other frequency, for example, infrared. After the command is sent, the grenade's ordnance initiator is triggered, detonating it. Typically, data transmission from the smart grenade ceases at detonation.

In military applications, it is important to prevent enemy forces from retrieving devices such as the smart grenade. If a user decides not to detonate a given grenade, after a predetermined time, the grenade will cease transmission. The grenades remaining power can be used to, for example, disable, destroy, or otherwise render useless internal circuits and transmission elements. In the preferred embodiment, this eliminates the grenade's usefulness to anyone who collects, disassembles, and/or attempts to reuse it.

Figure 3:
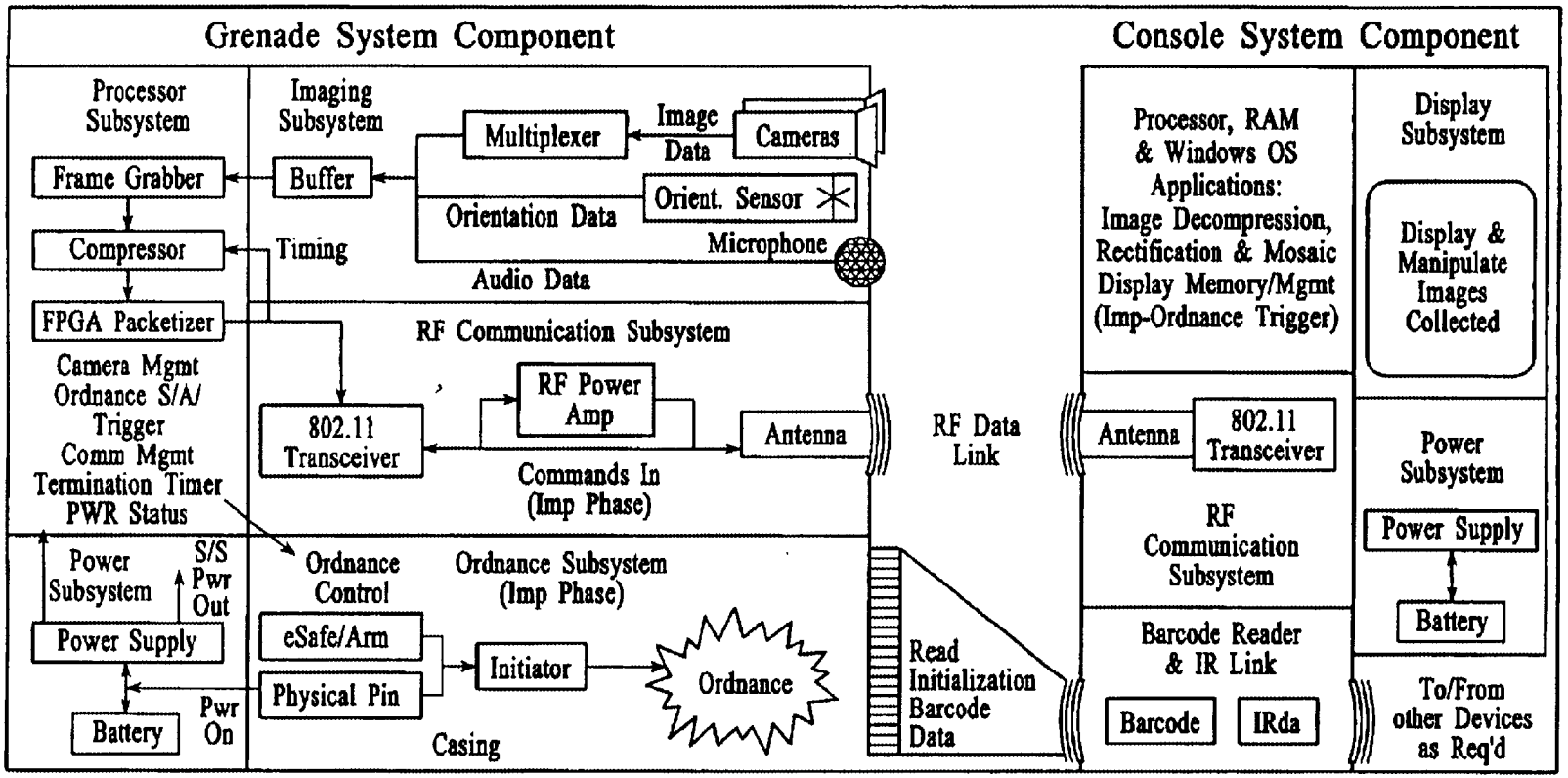
FIG. 3 is a block diagram showing the components present in a preferred embodiment of the present invention.

FIG. 3 is a block diagram showing the components present in a preferred embodiment of the present invention. As shown in FIG. 3, there present invention comprises two main components, for example, the grenade system component and the console system component. In the preferred embodiment, the two system components of the present invention comprise a number of exemplary subsystems. The subsystems that comprise the grenade system component are, for example, imaging, processor, RF communication, ordnance, and power. As will be recognized by those skilled in the art, the number of subsystems can be increased or decreased.

In the preferred embodiment, the imaging subsystem comprises components that are necessary for the acquisition of data. The imaging subsystem comprises, for example, one or more cameras, a multiplexer, orientation and audio sensors, and a data buffer. In the exemplary embodiment, data provided by the orientation sensor, for example, a miniature three axis magnetometer, serves several purposes. First, it can mange the on-board camera systems. For example, to conserve power, a camera that is facing the ground under the grenade, and providing no usable image data, could be turned off. In addition, the orientation sensor can provide the slope or tilt of the surface that the grenade is sitting on to the console user. Finally, outdoor images often lack vertical references that are helpful in image reconstruction, particularly at night. Data provided by the orientation sensor can eliminate or reduce this potential system shortcoming, and can improve image quality.

The exemplary processor subsystem comprises, for example, an image frame grabber, compressor, and a FPGA. In the exemplary embodiment, digital image data is captured by the digital camera of the imaging subsystem via the use of the digital frame grabber. The frame grabber, for example, captures a specific set of image data required to create an image at a given time from the streaming image data sent by the cameras of the imaging subsystem. The camera's output, for example, provides parallel pixel data, pixel clock, line valid, and frame valid signals. Frame grabbers for color and multispectral cameras, for example, collect up to 24 bits of parallel data per pixel. These frame grabbers generally operate at less than full motion frame rates, for example, five per second. In the exemplary embodiment, the image resolution may typically be, for example, 160×120 or 320×240. In the exemplary embodiment of the present invention, the frame rate and resolution can be determined by those skilled in the art, and is typically limited by factors such as power consumption and desired range.

In the exemplary embodiment, the compressor serves to compress data before it is transmitted. Technologies such as MPEG4, H.263, or motion JPEG can be employed. These technologies are well known to those skilled in the art. However, the present invention is not intended to be limited to these technologies. In the exemplary embodiment, these technologies deliver image compression ratios of up to several hundred to one, and transmitted image data rates of 200–400 kbps. The data compression method and implementation can be determined by those skilled in the art according to a particular application.

In the exemplary embodiment, a packetizer, for example, an FPGA, is used for preparing data to be sent. In the exemplary embodiment, the packetizer takes the data and encapsulates it into, for example, connectionless UDP/IP packets. These packets include, for example, destination headers, as required to comply with, for example, the 802.11 protocols, which are well known to those skilled in the art. In the preferred embodiment, the FPGA functions as the controller of the grenade system component to, for example, format data and manage other functions, for example, termination and ordnance.

The exemplary RF communications subsystem comprises, for example, an IEEE 802.11, 2.4 GHz chipset, a power amplifier, and an antenna. The IEEE 802.11, 2.4 GHz chipset is well known to those skilled in the art. In the preferred embodiment, the chipset handles both transmit and receive functions. The present invention is not intended to be limited to the IEEE 802.11, 2.4 GHz chipset. Any chipset can be used, as determined according to a particular application. In addition, the communications system does not have to function in the radio frequency spectrum. Any spectrum can be used for communications, and can be dependent on a plurality of factors.

The exemplary ordnance subsystem comprises, for example, an electronic safe and arm, initiator, and ordnance. The safe and arm may include, for example, a predetermined time delay to prevent ordnance initiation by a console user while the smart grenade is still in the hand of or near to the thrower. Finally, the exemplary power subsystem comprises, for example, the battery and power supply. Though the present invention was described with respect to systems and subsystems, this is not intended to limit the present invention. The systems and subsystems discussed can be changed, combined, or eliminated according to the objectives of a particular application.

In the preferred embodiment, the console system component comprises, for example, a barcode reader, RF communications system, processor, display, and power subsystem. In the preferred embodiment, the RF communications system receives data from the grenade, and sends it to the processor. The processor subsystem buffers the compressed data, decompresses, rectifies and mosaics the data, and sends images to the display. The display subsystem presents the image or images to the user and allows them to be manipulated. The barcode reader and the IR links interface with the grenade initialization barcodes.

The present invention can use any type of camera, or camera arrangement. In an exemplary embodiment, CMOS or CCD camera sensors could be used. The camera sensors can be embedded in the body of the grenade. Alternatively, the cameras can sit on the surface of the grenade. This can be determined according to a particular application. CMOS cameras are typically cheaper and have lower power requirements. However, they also typically have lower image quality and require more light. Alternatively, CCD cameras tend to consume more electrical power, but provide superior images. The camera arrangement of the present invention is determined according to the type of cameras used, and the shape of the grenade. An exemplary embodiment could use two different approaches to camera arrangement. One arrangement could be, for example, two cameras with 180 degree "fish eye" lenses. Another arrangement could be, for example, a plurality of narrow field of view cameras. In the exemplary embodiment, the cameras are multiplexed, sending their digital video streams to the RAM buffer. The digital video streams are complemented by substantially simultaneously collected orientation data and audio data. As will be recognized by those skilled in the art, the type and number of cameras can be changed according to a particular application.

In an exemplary embodiment of the present invention, the pictures taken by each camera are often distorted. To correct this distortion, the exemplary embodiment uses a set of calibration patterns to correct and "mosaic" multi-camera images into a "corrected," or more accurate image of the locale of the active smart grenade. Since there are multiple cameras employed, the desired image display is that of an undistorted, or "normal" appearance. In the preferred embodiment, each camera is registered by computing a perspective transform that aligns them to a common reference frame, and results in a lookup table that maps each pixel of each camera to a pixel in the image mosaic displayed by the console system component to the user. Thus, the image the user sees displayed by the console is free from most distortions. In the exemplary embodiment, a set of test images can map an individual grenades cameras to one of a set of lookup tables, minimizing correction variables. In the exemplary embodiment, each grenade would use its barcode to tell a console the correct lookup table to use to best display its images. As will be recognized by those skilled in the art, other methods of removing distortions can be employed.

In an exemplary embodiment, the frame rate of the cameras can be determined according to, for example, form, power and bandwidth constraints, and image quality. Other factors that can be used to determine the frame rate of the cameras includes, for example, motion compensation, power needs, and error resilience. In the exemplary embodiment, image data sent over a link, once collected and compressed, must minimize transmission errors. As images are compressed, the encode bit stream is more vulnerable to errors. Image error resilience is an important aspect of the present invention. Three exemplary techniques for error resilience can be used, for example, encoder based like-layer coding, concealing corrupted data at the decoder, or techniques employing both encoder and decoder modifications.

In the exemplary embodiment, audio data collection and transmission has a substantially minimal impact on power or RF requirements. In many situations, accurate sound acquisition and reproduction can significantly enhance situational awareness. When combined with visual information, it is usually critical to match picture and sound spatially. In the exemplary embodiment, selectively steered sound localization can be used, for example, to zoom into a particular conversation, or to reduce noise.

In the exemplary embodiment of the present invention, the grenade and console maintain contact through a link, for example, an RF link. In the exemplary embodiment, a COTS 802.11 WLAN modulator chipset, with a range increasing second stage power amp, is employed. The COTS 802.11 WLAN modulator chipset is well known to those skilled in the art. In the embodiment, the COTS chipset uses the 802.11 physical layer, but the medium access control layer is altered providing one way grenade to console communication. The link only operates with 802.11 receivers equipped with special device drivers, improving security, and also enabling the console to grenade link for ordnance initiation.

The exemplary transmitter operates in, for example, 1 Mbps mode, and maximizes the spreading (anti-jam) benefit and energy per bit at the receiver. Additionally, the exemplary transmitter automatically tunes to, for example, one of eleven standard overlapping 22 MHz bands in the 2.4 GHz band, to avoid interferers, for example, other smart grenades operating nearby, or other users of the frequency band. However, any frequency band can be used in accordance with the present invention. In an exemplary embodiment, if multiple transmitters are employed, they can be supported in a time division manner using, for example, carrier sense multiple access (CSMA). With CSMA, each unit listens on its channel for traffic, and transits a packet when the channel is clear. If transmissions overlap, both transmitters wait a random time, and then attempt to re-transmit. CSMA is well known to those skilled in the art.

Figure 4:
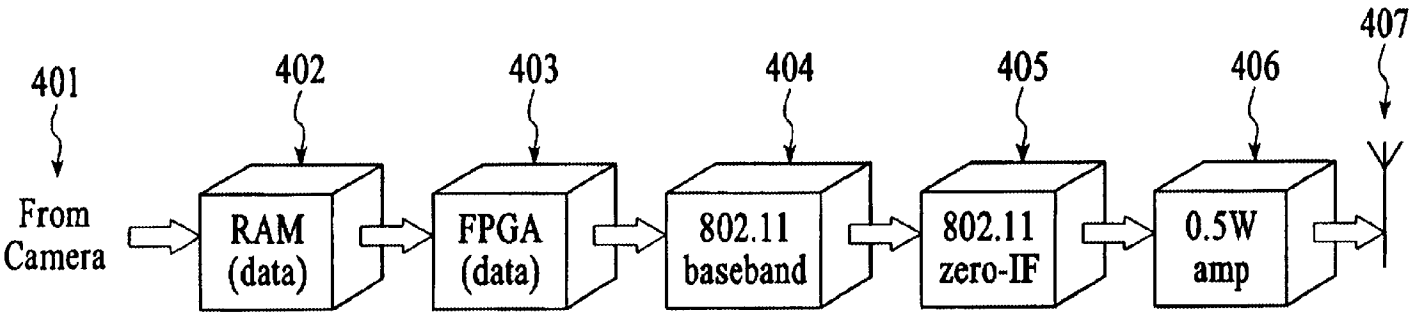
FIG. 4 is a block diagram showing the signal flow in an exemplary embodiment of the present invention.

FIG. 4 is a block diagram showing the signal flow in an exemplary embodiment of the present invention. As images are acquired from the camera 401, the images are compressed, and stored in a buffer 402. The FPGA 403 formats the message data, and controls the chipset, for example, the 802.11 chipset described with respect to FIG. 3. The baseband modulator 404 produces a waveform, for example, an 11 MHz waveform. The upconverter 405 then converts the signal to, for example, a 2.4 GHz signal with a signal power of, for example, 18 dBm. The second stage amplifier 406 provides, for example, 9 dB of gain, bringing the RF output of 23 dBm (0.5W) through the omnidirectional antenna 407. Though the signal flow of the present invention has been described with respect to a series of steps, the present invention is not intended to be limited to any steps, or sequence thereof.

In the exemplary embodiment, the grenade requires electrical power to operate. In the exemplary embodiment, the grenade requires, for example, between 6–8 watts of power continuously. The exemplary grenade operates for, for example, 15 minutes. However, this can be increased or decreased based on a given application and available battery or other electrical power source. In the embodiment, the battery is designed to occupy, for example, less than 20 percent of the grenades volume. In order to accomplish this, a primary cell with both high energy density and discharge rate capability is required. In the exemplary embodiment, batteries that can be used to satisfy this requirement are, for example, alkaline L123 cells, high capacity UltraLife, and "C" or pouch $Li/Mn0_2$ cells. These are just examples, and are not intended to limit the present invention. As will be recognized by those skilled in the art, devices to provide higher or lower voltages to the various components of the grenade can be incorporated into the present invention.

In the exemplary embodiment, the grenade can take on a variety of shapes. The grenade can be constructed of any material, for example, plastic or metal. The shape and the size of the grenade can be designed according to a particular application. The present invention is not intended to be limited to one size or shape. The shape is typically chosen in conjunction with the type and number of cameras, although this is not a requirement. The grenade be shaped, for example, as a cylinder, as a pyramid, as a tetrahedron, or as a cube. These are just some examples, and are not intended to limit the present invention.

In the preferred embodiment of the present invention, the console receives images and orientation data from the grenade. After decompression, the images are buffered and resynchronized using, for example, time stamp information. For each exemplary time stamp, using the lookup table of a particular grenade, panoramas are constructed from the individual images. FIGS. 5*a–b* show exemplary corrected and uncorrected camera images. FIG. 5*a* shows an exemplary five camera, uncorrected view. FIG. 5*a* represents the picture as it is acquired by the grenade system component's cameras. FIG. 5*b* shows the corrected partial mosaic as it would be displayed on the console. In the preferred embodiment, image rectification and mosaicing is done at the console. This is done, for example, using software that is capable of concurrent processing of data streams.

Although the invention has been described with reference to particular embodiments, it will be understood to those skilled in the art that the invention is capable of a variety of alternative embodiments within the spirit of the appended claims.

What is claimed is:

1. A grenade comprising:

a casing;

an ordnance within the casing;

a power subsystem coupled to the casing; and an imaging subsystem coupled to the power subsystem, the imaging system being adapted to capture one or more images.

2. The grenade of claim 1 wherein the casing is made of a material selected from a metal or a plastic.

3. The grenade of claim 1 wherein the power subsystem comprises a battery source.

4. The grenade of claim 1 wherein the imaging system comprises a plurality of charge coupled devices.

5. The grenade of claim 1 wherein the one or more images can be from a non-friendly environment.

6. The grenade of claim 1 wherein the ordnance is adapted to be detonated from a remote device.

7. The grenade of claim 1 further comprising a display coupled to the imaging subsystem, the display being adapted to output the one or more images to a user.

8. The grenade of claim 1 wherein the imaging subsystem includes a portion within the casing.

9. The grenade of claim 1 wherein the one or more images is associated with immediate surroundings of the grenade.

* * * * *